US006637420B2

(12) United States Patent
Moritz

(10) Patent No.: US 6,637,420 B2
(45) Date of Patent: Oct. 28, 2003

(54) CLOSED BOLT ASSEMBLY FOR A PAINTBALL MARKER GUN

(76) Inventor: Colin Bryan Moritz, 558A Moritz La., Victoria, TX (US) 77905

( * ) Notice: Subject to any disclaimer, the term of this patent is extended or adjusted under 35 U.S.C. 154(b) by 0 days.

(21) Appl. No.: 10/119,098

(22) Filed: Apr. 9, 2002

(65) Prior Publication Data

US 2003/0000511 A1 Jan. 2, 2003

Related U.S. Application Data

(60) Provisional application No. 60/302,201, filed on Jun. 29, 2001.

(51) Int. Cl.[7] ..... F41B 11/32
(52) U.S. Cl. ..... 124/73; 124/76
(58) Field of Search ..... 124/72, 73, 74, 124/75, 76, 77, 31

(56) References Cited

U.S. PATENT DOCUMENTS

| | | | | | |
|---|---|---|---|---|---|
| 5,413,083 | A | | 5/1995 | Jones | |
| 5,462,042 | A | * | 10/1995 | Greenwell | 124/76 |
| 5,503,137 | A | | 4/1996 | Fusco | |
| 5,505,188 | A | | 4/1996 | Williams | |
| 5,515,838 | A | | 5/1996 | Anderson | |
| 5,613,483 | A | | 3/1997 | Lukas et al. | |
| 5,881,707 | A | | 3/1999 | Gardner, Jr. | |
| 5,890,479 | A | * | 4/1999 | Morin | 124/31 |
| 5,913,303 | A | * | 6/1999 | Kotsiopoulos | 124/31 |
| 6,035,843 | A | | 3/2000 | Smith et al. | |
| 6,065,460 | A | | 5/2000 | Lotuaco, III | |
| 6,142,136 | A | | 11/2000 | Velasco | |
| 6,343,599 | B1 | * | 2/2002 | Perrone | 124/73 |
| 2002/0088449 | A1 | * | 7/2002 | Perrone | 124/74 |

* cited by examiner

*Primary Examiner*—Charles T. Jordan
*Assistant Examiner*—John W. Zerr
(74) *Attorney, Agent, or Firm*—Sherman D. Pernia

(57) ABSTRACT

A replacement bolt action assembly useful for converting a gas operated paintball marker gun having an open bolt type action to a closed bolt type action is provided. The open bolt type action includes a combination open bolt and hammer assembly releaseably containable in the marker gun body, an actuator (trigger) assembly disposable in the marker gun frame in mechanical communication with the bolt and hammer assembly, for releaseably holding the bolt and hammer assembly in a cocked configuration; and a pressure control assembly in mechanical communication with the actuator assembly and in gas flow communication with the bolt and hammer assembly. The present invention can be provided as a kit for converting or replacing the actions of certain existing paintball marker guns to close bolt type actions without having to modify the structure of the existing gun's receiver or marker body.

18 Claims, 6 Drawing Sheets

CLOSED BOLT ASSEMBLY FOR A PAINTBALL MARKER GUN

The present invention claims the benefit of prior filled U.S. Provisional Patent Application Ser. No. 60/302,201, filed Jun. 29, 2001, and incorporated herein by reference.

FIELD OF THE INVENTION

The present invention is in the field of mechanical guns and projectors in which the projectile impelling apparatus utilizes a nonexplosive propelling agent. More specifically, the present assembly relates to devices provided with a chamber for containing pressurized gas and include a check valve to admit or release the gas from the chamber to cause the projectile to be positioned in or expelled from a paintball gun.

BACKGROUND OF THE INVENTION

"Paintball" is a currently popular recreational sport in which members of opposite teams attempt to mark opponents with paint, thereby removing them from the game. Marking is accomplished by using a paintball marker gun to shoot a projectile (paintball) containing paint or other appropriate marking material at an opponent. Paintballs are spherical capsules filled with paint or other marking material which burst upon impact. Upon contact with a player, the paintball ruptures, thus marking the player. Once a player is marked, he/she is out of the game.

A variety of different types of paintball marker guns exist in the field, using a variety of mechanisms for accomplishing their purpose of projecting paintballs. Two of the types of actions used on marker guns are the open bolt action and the closed bolt action. The open bolt type of action is used on simple, relatively inexpensive types of marker. In the open bolt action, the gun body comprises two parallel tubular bores. The upper bore contains the bolt, while the lower bore contains the hammer. The bolt and hammer components are connected together, allowing their moving parts to move in concert. The bolt and hammer assembly is held in the cocked position via a trigger sear, which catches the hammer portion of the assembly. In this position, the breach is open and a paintball is able to drop into position in front of the bolt. When the trigger is pulled, the sear releases the hammer and a spring drives the hammer and bolt forward. As the bolt moves forward, it chambers a paintball into the barrel of the marker gun. Simultaneously, the hammer moves forward to strike a poppet valve as the bolt closes on the chamber. The poppet valve releases a burst of high pressure gas into and through the bolt, expelling the paintball from the barrel. A bleed-off of the burst of high pressure gas then propels the hammer and bolt backwards. The hammer is then caught by the trigger sear, and the marker is again in a cocked configuration and ready to be fired again. This type of action is called an open bolt action because when the marker is in the cocked configuration the bolt is in the open position. Because of its early and inexpensive design, marker guns utilizing the open bolt action represent a significant proportion of the marker guns in use.

However, open bolt action has certain disadvantages. Since the paintball is forcibly moved forward by the bolt milliseconds before the air release to the barrel, the paintball may be damaged by causing distortions in the paintball's surface. This leads to adverse effects on the paintball's flight path and decreases accuracy. Another problem occurs when the bolt catches a paintball that is halfway loaded and chops it in half ("ball chop"). This can coat the barrel with paint, greatly ruining accuracy and potentially jamming the marker. This jamming requires the marker be disassembled for cleaning before continued use.

The closed bolt action overcomes these disadvantages. The closed bolt action differs from the open bolt action in that in the closed bolt action, when the marker gun is in the cocked configuration the bolt is in the closed position, and a paintball is already chambered in the barrel. Also, in a closed bolt action, the hammer is no longer connected to nor moves in concert with the bolt. Because when the gun is fired, only the hammer moves, there are fewer inertial forces at play during the actual discharge of the marker. Additionally, the paintball is not impacted by the bolt immediately before it is discharged from the marker gun, and therefore, the paintball should experience less surface distortion. This combination of fewer inertial forces and reduced distortion of the surface of the projectile should improve precision and accuracy of a closed bolt marker over the same marker using an open bolt action.

Examples of paintball marker guns used in the field include Anderson, U.S. Pat. No. 5,515,838 (paintball gun with a passage for porting pressurized gas to a ball projectile); Lukas et al., U.S. Pat. No. 5,613,483 (a gas powered gun with a piston and cylinder assembly for ejecting projectiles from the gun) and Lotuaco, III, U.S. Pat. No. 6,065,460 (gas-powered paintball gun with two pressure regulators; one for supplying lower pressure for loading paintballs and one for high pressure for expelling the paintball from the barrel.)

Currently, the investment to own even an open bolt action marker gun is substantial. Moving to the next level of marker gun with a closed bolt action, is an even greater expense. Therefore, the field has been motivated to develop means for converting or modifying for a number of purposes, including converting an open bolt action marker gun to closed bolt action type gun.

One example of a conversion kit is Fusco, U.S. Pat. No. 5,503,137. Fusco describes a conversion kit for converting a pump-action type compressed gas gun to a semi-automatic type compressed gas gun. The kit includes an actuating mechanism, a gas distributing mechanism, and an activating mechanism. The parts are removably connected to the gun, allowing for the gun to be returned to its original configuration upon removal. Another attachment to modify a paintball gun is described by Jones, U.S. Pat. No. 5,413,083. This attachment allows the gun to fire in automatic, semiautomatic or any other pattern of fire. The attachment includes a mechanical mechanism for manipulating a protrusion on the gun, such as the bolt handle, a programmable pulse generator for determining the pattern of fire, and an electromagnetic device for converting signals from the pulse generator into a mechanical motion for driving the mechanical mechanism.

Therefore, it would be beneficial to enable the owner of an open-bolt marker gun to convert the marker to a closed bolt marker, and avoid the expense of having to purchase a new marker gun in order to take advantage of closed bolt action technology. It would be further beneficial if the conversion did not require the structural modification of the original marker gun, so that the marker gun could be returned to its original configuration.

SUMMARY OF THE INVENTION

The present invention is a closed bolt action assembly for an existing gas operated paintball marker gun. Typically, a marker gun includes two primary structural components: the receiver (or marker gun body) and the trigger group (or marker gun frame). The present closed bolt action assembly can be used in the production of new units of the existing paintball marker gun or it can be used to replace the action assembly in a prior production unit. A paintball marker gun typically is made up of two major structural components: a marker gun body and a frame. Existing paintball marker guns that comprised body and frame combinations that were compatible with the present invention without structural modification of the body or frame include: the KINGMAN SPYDER™, and AVALON's GT COMMANDO. Other existing marker guns with which the present invention is intended to be compatible include the REBEL™ by 32DEGREES; PMI's PIRANHA, NPS's GT2000, and VIEWLOADER's GENESIS. It is anticipated that the present invention will be generally compatible with any paintball marker gun having receiver and frame structural characteristics analogous to these marker guns.

The present closed bolt action assembly comprises a combination bolt and hammer assembly, an actuator assembly and a pressure control assembly. The bolt and hammer assembly is releaseably containable in the marker gun body. The marker body is a pair of parallel cylindrical tubes integrally fixed together along a length of their outer surfaces. The marker body in turn is mounted on the marker gun frame in an "over and under" configuration. The actuator assembly is disposed in the marker gun trigger group or frame in mechanical communication with the bolt and hammer assembly. The actuator assembly releaseably holds the bolt and hammer assembly in a cocked configuration prior to discharge of the marker gun. The actuator assembly includes the trigger for the gun. The pressure control assembly is in mechanical communication with the actuator assembly and in gas flow communication with the bolt and hammer assembly. The pressure control assembly controls low pressure gas flows to drive certain operations of the bolt and hammer assembly, such as opening and closing the bolt.

The bolt and hammer assembly comprises separate bolt and hammer components which operate independently of each other when they are installed in the marker body. The bolt is installed in the upper or "over" tube of the marker gun body, and the hammer is installed in the lower or "under" tube. The bolt opens the breech of the marker gun allowing a paintball projectile to be loaded into the marker gun. The bolt then closes the breech and chambers the projectile into the barrel of the marker gun. The operation of the bolt is controlled by the low pressure gas controller assembly. The action of the hammer operates a high pressure gas valve to open a high pressure gas flow path between a source of high pressure gas and the chamber of the barrel. A portion of the high pressure gas flow path is through the bolt head of the bolt when the bolt is in the closed position.

The bolt of the bolt and hammer assembly is further comprises an air ram, mounting means, a bolt head and low pressure gas lines. The air ram is pneumatic cylinder housing a double action piston. The piston is double action in that it can be driven in two directions. A piston shaft is attached to the piston and protrudes from one end of the pneumatic cylinder of the air ram. The piston shaft is driven by movement of the piston within the air ram cylinder. The other end of the pneumatic cylinder is attached to an air ram mounting block. The ram mounting block in turn is received into the over tube of the gun body proximate its breech end, and retained there by a locking pin. Two low pressure gas ports are disposed on the air ram in communication with an interior space of the pneumatic cylinder, one each for driving the piston in either direction. At the front end of the air ram, a bolt head is attached to the protruding end of the piston shaft. The term "front" as used herein regarding a structure or component refers to that portion of the thing most proximate the muzzle of the barrel of the marker gun in which it is installed. The bolt head is driven by movement of the piston within the pneumatic cylinder of the air ram. Additionally, a bolt sealing disk is disposed proximate the front end of the ram. The sealing disk provides stability to the front end of the air ram and pneumatic isolation of the bolt head from the rest of the bolt.

The bolt head is substantially a cylinder having a central axis, a solid circumferential surface. The front end of the bolt head is the bolt-face end. The bolt face is typically concave to compliment the shape of the paintball projectile. The back end of the bolt head engages the piston shaft end of the air ram. An inside-mating surface is provided along at least a portion of the central axis at the back end of the bolt head to receive the piston shaft end. A plurality of gas flow passages are disposed in the bolt head, passing through the bolt-face and breech ends of the bolt head. The passages are a portion of the high pressure gas pathway that supplies propellant to project a chambered paintball from the barrel of the marker gun.

The ram mounting block is substantially cylindrical and is closely received into the lumen of the over tube of the marker body when installed. The ram block has a longitudinal tab along at least part of its outer surface in parallel with the axis of the cylinder of the ram block. On installation of the bolt, the tab is received into a portion of a slot in the rear or breech end of the marker body, which slot is open to the interior space or lumen of both the over and under tubes of the marker body. The ram block tab incorporates a complementary part of a detent by which the bolt and hammer assembly is retained in position in the marker body after its installation.

The hammer assembly of the present invention also has a generally cylindrical configuration and comprises a cylindrical striker in axial alignment with a cylindrical tensioner block and a bias spring disposed along the axis between the striker and the tensioner block. The bias spring functions to axially separate the striker from the tensioner block. The striker has solid front face for impacting a high pressure gas flow control valve to cause the valve to open. The rear end of the striker has a coaxial lumen along a portion of its axis for receiving one end of the bias spring. The front face of the tensioner block has a coaxial lumen along a portion of its axis for receiving the bias spring.

A detent complimentary to the detent on the tab of the ram block defines the upper surface of the tensioner block. A locking pin passing through the marker body and simultaneously engaging the detents on both the ram block and the tensioner block retains the bolt and hammer in the marker body. Additionally, the tensioner block has a pre-loading means for adjusting the normal bias of the bias spring. Typically this is accomplished by having an adjusting screw pass through the axis of the tensioner block from its rear surface to impinge on the end of the bias spring received in the lumen of the block. Turning the screw alters the normal length of the bias spring and hence the initial bias load or force exerted by the bias spring.

Cocking the marker gun causes the striker to be drawn toward the tensioner block against the force of the bias spring. Cocking the marker gun is manually accomplished by drawing the cocking rod to its fully extended position. When the striker has been drawn a distance toward the tensioner block to store sufficient energy in the bias spring, a trigger notch on the lower surface of the striker engages a sear lever on the marker gun frame and is retained at this position inside the under tube. In this configuration, the hammer of the marker gun is cocked. Upon operation of the sear lever to disengage it from the trigger notch, the striker flies forward under the force of the bias spring and impacts the high pressure gas flow valve (e.g., a poppet valve) causing it to operate and open a high pressure gas flow path to the over tube. Once the high pressure valve is operated, a bleed off pressure from the high pressure gas flow path to the lumen of the under tube in front of the striker causes the striker to be drawn back again against the force of the bias spring until the hammer is again cocked. This is how the hammer is automatically cocked after the marker gun is discharged.

However, before the action is able to automatically re-cock the marker gun after being discharged, it must be manually cocked before the first time it is discharged. This is accomplished by operation of a manual cocking rod. The manual cocking rod is a metal rod having two ends. The front end of the cocking rod freely passes through a hammer link pin mounted to the top surface of the striker. The front end of the cocking rod has a stop at its terminus to prevent its being withdrawn from and for engaging the link pin. The link pin not only serves to couple the cocking rod to the striker, but also serves to maintain the striker in the proper orientation, so that the trigger notch is always bottom most on the striker. The length of the cocking rod slidably passes through the air ram mounting block, parallel to the axis of both the over and the under tubes. The rear end of the cocking rod extends outside the marker body and is adapted to be manually gripped and withdrawn from the marker body to place the hammer of the bolt and hammer assembly in a cocked configuration.

In an alternative embodiment, the cocking rod may be completely integrated into the hammer assembly. In this embodiment, the cocking rod does not engage the link pin, but rather, is disposed to engage a striker insert received in the bore of the striker/hammer. The cocking rod then extends from the marker gun by passing through the tensioner block rather than the air mounting ram.

The actuator assembly is installed in the marker gun trigger group or frame as part of the discharging mechanism of the marker gun. The actuator assembly comprises the trigger of the marker gun, which when the present invention is installed, is in direct mechanical communication with the pressure control assembly, and with the means for releaseably holding the bolt and hammer assembly in a cocked configuration (the trigger sear lever). The actuator mechanism includes a link rod which mechanically connects the trigger to the pressure control assembly. Alternatively, the actuator assembly has been practiced using a slide switch to mechanically connect the trigger to the pressure control assembly, instead of the link rod.

The pressure control assembly is in part installed on the marker gun frame and in part on the marker body. The pressure control assembly comprises a slide operated, two-way, low pressure gas valve in direct mechanical communication with the trigger of the actuator assembly. The low pressure gas valve is mounted to the marker frame using a mounting bracket or a stand-off. Three low pressure gas lines are connected to the low pressure valve. The other end of the incoming or primary gas line is connected to a low pressure gas regulator which provides low pressure gas for the gas pressure control assembly. In turn, the low pressure gas regulator is connected to the marker gun body in gas flow communication with the high pressure gas source of the marker gun. The low pressure gas regulator is adjustable to regulate an amount of reduction of gas pressure accomplished by the regulator.

The other two low pressure gas line are connected to the outputs of the low pressure valve. These are the first and second secondary gas lines. At its other end, the first secondary gas line is connected in gas flow communication with the piston return port on the air ram, and the second secondary gas line is connected in a similar manner in gas flow communication with the piston extension port on the air ram.

The present invention may be used to convert an existing paintball marker gun from an open bolt action to a closed bolt action. The process for accomplishing this comprising the steps of removing the existing bolt and hammer assembly from the marker gun and installing the present combination bolt and hammer assembly in the marker gun in it place. Replacing the existing trigger of the marker gun with the present actuator assembly, and installing the pressure control assembly on the marker gun, connecting the pressure control assembly to the actuator assembly and to the bolt and hammer assembly to provide a paintball marker gun having a closed bolt action. This conversion is accomplished without modification of the existing marker gun body or frame. The present invention is provided as a kit to facilitate a user's converting an open bolt action paintball marker gun to a closed bolt action. The kit includes the closed bolt action assembly described herein, instructions and container or package for containing the closed bolt action assembly and the instructions.

DETAILED DESCRIPTION OF THE INVENTION

Figure 1:
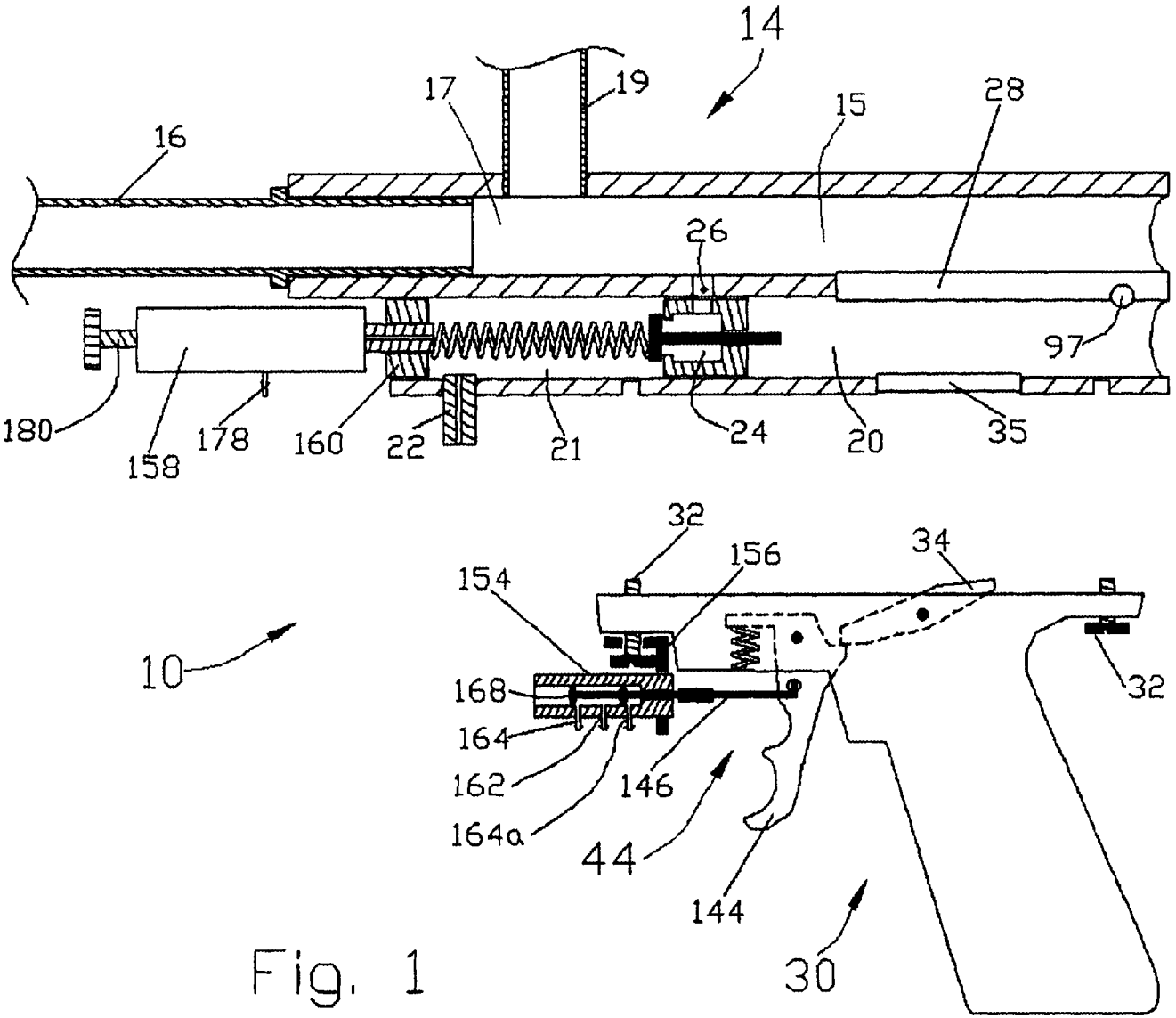
FIG. 1 is a partial cross-sectional plan view of the major components of the present invention, showing their relationship to a marker gun receiver and trigger group.

Referring now to the drawings, the details of preferred embodiments of the present invention are graphically and schematically illustrated. Like elements in the drawings will be represented by like numbers, and similar elements will be represented by like numbers with a different lower case letter suffix.

The present invention is a closed bolt action assembly for a gas operated paintball marker gun 10. As shown in FIG. 1, the marker gun 10 includes a marker gun body or receiver 14, and a marker gun frame or trigger group 30. The present closed bolt action assembly is installed in or attached to the marker gun receiver 14 and frame 30. The present closed bolt action assembly is installable into an existing marker gun receiver/frame combination, to replace a defective existing action assembly or to convert an open bolt action assembly to a closed bolt action assembly, without modification of the existing receiver/frame combination. Existing marker gun receiver/frame combinations that are practicable with the present invention include the KINGMAN SPYDER™ and other as noted above.

FIG. 1 shows a marker gun 10 having a receiver/frame combination practicable in the present invention. The receiver 14 is a duel lumen tube containing two parallel bores in an "over & under" configuration when mounted on the trigger group or frame 30. The upper or "over" bore 15 mounts the barrel 16 of the marker gun at its front end and includes the breech 17 where paintball projectiles 18 are loaded into the marker gun 10 from a magazine 19 or similar loading mechanism. Paintball magazines and similar projectile loading mechanisms are known in the field and are readily adaptable for practice on the present invention by the ordinaiy skilled artisan. The lower or "under" bore 20 houses the high pressure gas chamber 21 and mounts tAe high pressure gas input port 22, which is in turn connected to a high pressure gas source (not shown). The "under" bore 20 also houses the high pressure gas valve 24 which controls high pressure gas flow through the high pressure gas passage 26 between the over bore 15 and the under bore 20. The receiver 14 and any attachments are mounted on the trigger group or frame 30 in a vertical orientation with the over bore 15 uppermost. The marker gun trigger group attaches to the receiver 14 by way of fasteners 32 and is in mechanical communication with the receiver 14 by way of the trigger sear lever 34.

Figure 2A:
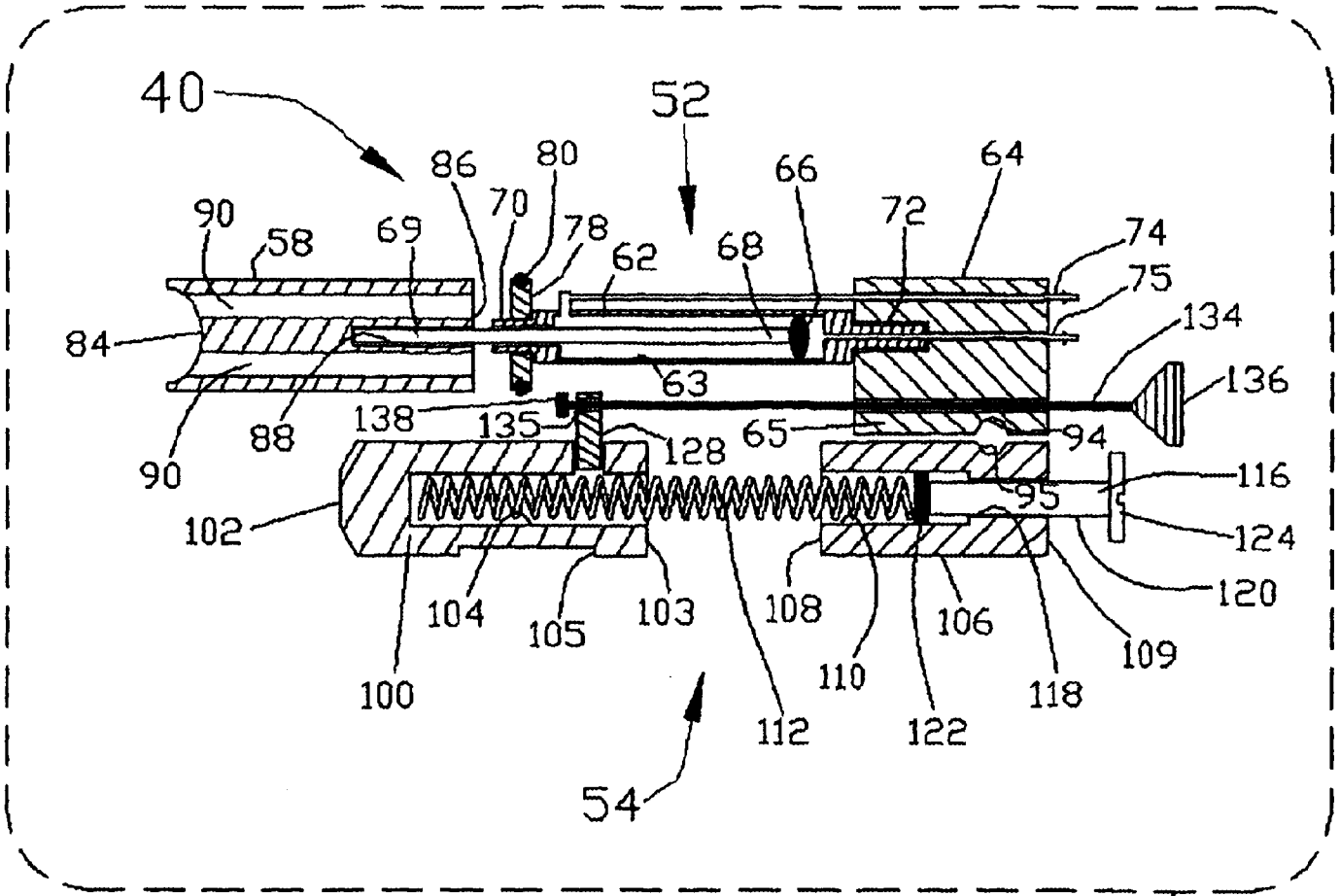
FIG. 2A is a partial cross-sectional view of the bolt and hammer assemblies of the present invention.

The present open bolt action assembly itself comprises a combination bolt and hammer assembly 40, an actuator assembly 44 and a pressure control assembly 48. As shown in FIG. 2A, the bolt and hammer assembly 40 comprises two major subassemblies: a bolt 52 subassembly and a hammer 54 subassembly. The bolt and hammer assembly 40 is removably installed in the marker gun receiver 14, with the bolt 52 installed in the lumen of upper or "over" bore 15, and the hammer 54 installed in the lumen of the lower or "under" bore 20. The action of the bolt 52 provides for opening and closing the breech 17 to automatically load a paintball projectile 18 into the marker gun 10 from an attached magazine 19. The bolt 52 then chambers the projectile 18 into the barrel 16 of the marker gun 10.

The bolt 52 is comprised of a bolt head 58, and an air ram 62 and an air ram mounting block 64. See FIG. 2A. The air ram 62 is a pneumatic cylinder 63 housing a double action piston 66, the shaft 68 of which protrudes from the first or front end 70 of the pneumatic cylinder 63 of the air ram 62. The bolt head 58 is connected to the front end of the piston shaft 68. The ram mounting block 64 fixedly receives the second or rear end 72 of the air ram 62 and releaseably retains the bolt 52 in the marker body 14. Two low pressure gas cylinder ports 74 & 75 are disposed in communication with the interior space of the pneumatic cylinder 63 to deliver low pressure gas proximate each end of the ram 62. A bolt sealing disk 78 is disposed proximate the front end 70 of the air ram 62. The sealing disk 78 provides structural stability to the air ram 62 and pneumatic isolation of the bolt head 58 from the air ram 62 and ram mounting block 64 within the over bore 15. In a preferred embodiment, the sealing disk 78 utilized an "O"-ring 80 retained about the circumference of the disk 78 to accomplish its sealing feature. Other means of accomplishing the sealing feature of the disk 78 are known to one of ordinary skill in the art and are practicable in the present invention. The air rams 62 practiced in the preferred embodiment were commercially acquired from ANS and J&J. These vendors and/or other for certain component parts of the present invention are known to the ordinary skilled artisan.

In operating the bolt 52, when low pressure gas is applied to the rear cylinder port 75 the piston 66 is moved toward the front end 70 of the pneumatic cylinder 63. This action extends the shaft 68 and the attached bolt head 58 forward into the breech 17 and against the chamber of the barrel 16. A paintball projectile 18 positioned in the breech before this action is moved forward by the bolt head 58 and chambered into the barrel 16. With the bolt head 58 in this position, the breech 17 is sealed and the bolt 52 is in the closed configuration. The bolt 52 is held closed in the breech 17 during firing by the pressure differential across the bolt head 58, since the highest gas pressure during firing initially occurs at the rear of the bolt head 58 and expands through it into the barrel 16. When low pressure gas is applied to the front cylinder port 74 the piston 66 is moved toward the rear end 72 of the pneumatic cylinder 63. This action retracts the shaft 68 into the pneumatic cylinder 63 and withdraws the bolt head 58 away from the barrel 16, and backward past the breech 17. With the bolt head 58 in this position, the breech 17 is opened and the bolt 52 is in the opened configuration.

The bolt head 58 is cylindrical, having a central axis and a solid circumferential surface. The front end of the bolt head 58 is the bolt-face 84. Preferably, the bolt face 84 is contoured to at least partially complement the shape of the projectile 18 it loads into the barrel 16 (see FIG. 2A). The ram end 86 of the bolt head 58 has an inside-mating surface 88 along at least a portion of the central axis of the bolt head 58, for receiving and attaching to the piston shaft 68 of the air ram 62. Preferable, the mating surface 88 is threaded and disposed to engage a complementary thread on the front end 69 of the piston shaft 68. A plurality of gas flow passages 90 pass through the bolt head 58 communicating between the bolt-face 84 and ram end 86 of the bolt head 58.

Figure 2B:
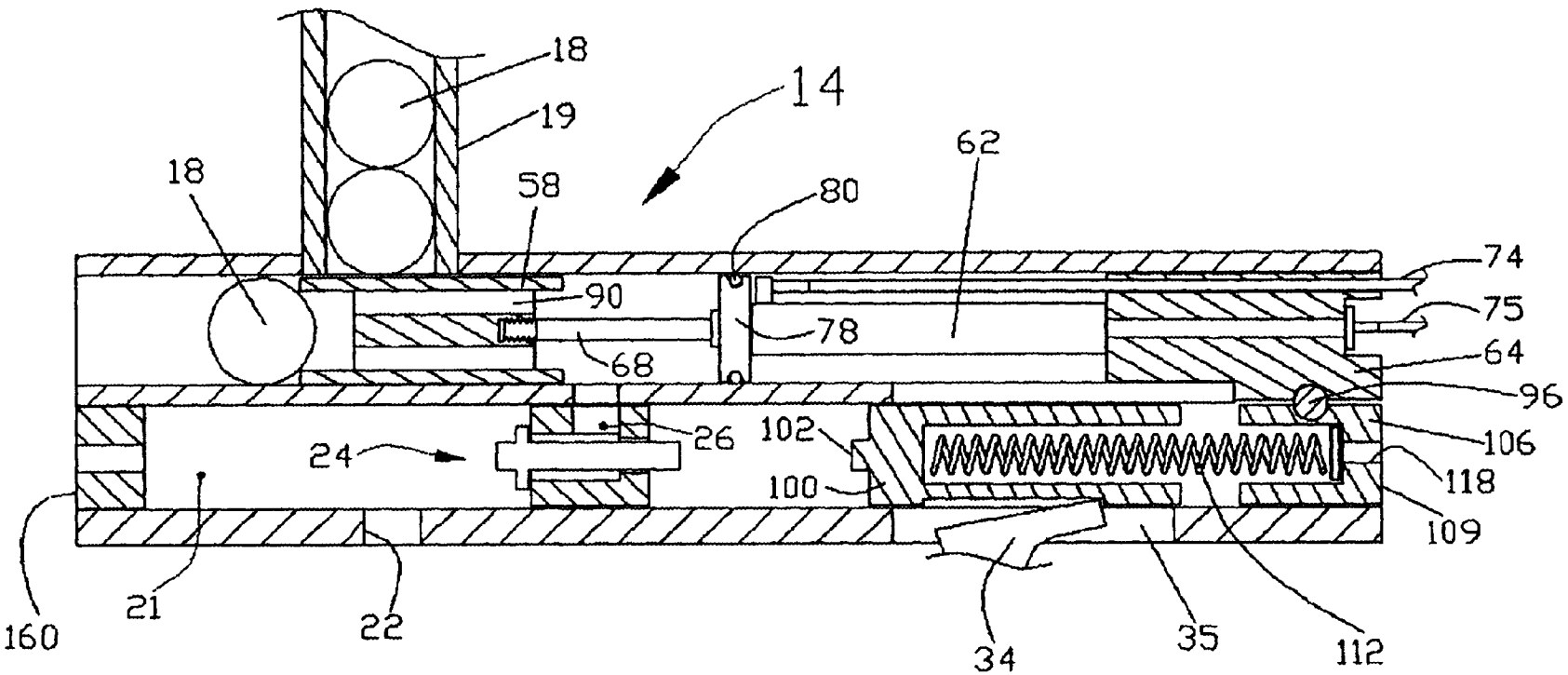
FIG. 2B is a partial cross-sectional view schematic illustrating how the bolt and hammer assemblies are installed into a marker gun receiver.

The ram mounting block 64 is substantially cylindrical and is closely received into the lumen of the over tube bore 15 of the receiver 14 when installed, e.g (See FIG. 2B). The ram block 64 has a longitudinal tab 65 in parallel with the axis of the block 64 and extending radially from its outer surface. On installation of the bolt 52, the tab 65 is received into a portion of the receiver slot 28 in the rear or breech end of the receiver 14. The receiver slot 28 is open to the interior space or lumen of both the over and under bores 15 & 20 of the marker body 14. The ram block tab 65 incorporates a complementary part of the detent 94 by which the bolt and hammer assembly 40 is retained in position in the marker receiver (marker body) 14 after its installation.

The hammer subassembly 54 functions to operate the high pressure gas valve 24 to open the high pressure gas flow passage 26 between the high pressure gas chamber 21, through the bolt head 58 to the barrel 16 on the marker gun 10. The hammer 54 is comprised of a cylindrical striker 100 in axial alignment with a cylindrical tensioner mount 106. A hammer spring 112 is disposed in axial alignment between striker 100 and the tensioner 106. When the hammer 54 is retained in place in the under tube bore 20, the tensioner block 106 is fixed in place and the striker 100 is slidable within the under tube bore 20. The bias of the hammer spring 112 acts to axially separate the striker 100 away from the tensioner mount 106. The striker 100 has an impact face 102 and a rear face 103. The striker also has a coaxial lumen 104 open at its rear face 103 and extending along a portion of its axis for receiving the hammer spring 112. The tensioner mount 106 has a tensioner front face 108 and a tensioner rear face 109, with a coaxial lumen 110 open at its front face 108 and extending along a portion of its axis for receiving the bias spring 112. The tensioner mount 106 has a pre-loading means 116 (velocity adjustment screw) for adjusting the bias or force the hammer spring 112 exerts on the striker 100 and the tensioner 106. In a preferred embodiment, the tensioner mount 106 had a threaded aperture 118 which received a complementary threaded adjusting screw 120 extended through the aperture 118. The front screw end 122 impinged on the hammer spring 112 received in the tensioner lumen 110. The rear screw end 124 was slotted as a manual manipulating means for altering the distance the adjusting screw 120 extended into the tensioner lumen 110 to pre-load the bias of the hammer spring 112. Other means of accomplishing a manipulating means are known to the ordinary skilled artisan that are practicable in the present invention, such as knurled screws and winged screws.

Additionally, the tensioner mount 106 has a detent 95 complimentary to the detent 94 on the tab 65 (see FIG. 3) of the ram block 64. A locking cross pin 96 passes through a pin aperture 97 in the marker receiver 14 and simultaneously engaging the detents 94 & 95 on both the ram block 64 and the tensioner mount 106 to retain the bolt and hammer in the marker body 14. See FIG. 2A.

Although the striker 100 is cylindrical, in a preferred embodiment its axial orientation within the under bore 20 was fixed. In that preferred embodiment, the striker 100 had a trigger sear notch 105 in a portion of its outer surface. The trigger notch 105 engaged the trigger sear 34 on the marker gun frame 30 and retained it at this position inside the under tube 20. In that configuration, the hammer 54 of the marker gun 10 was cocked. The trigger notch 105 was maintained in a downward most position relative to the position of the over bore 15 by means of a link pin 128 which protruded from the outer surface of the striker 100 opposite the trigger notch 105. Upon movement of the striker 100, the link pin 128 traveled in the bore slot 28 (see FIG. 1) between the over and under bores 15 & 20 in the existing marker receiver 14.

Figure 3:
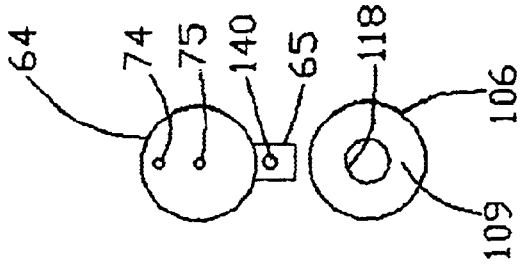
FIG. 3 is a rear elevation view of an air ram mounting block and a hammer tensioner block showing the over and under relationship of the two components as installed in the receiver of the marker gun.

The bolt and hammer assembly 40 includes a means of manually cocking the hammer 54 to initiate the automatic cycling of the present closed bolt action This was accomplished in a preferred embodiment, wherein the link pin 128 was in operative communication with a manual cocking rod 134. The manual cocking rod 134 slidably passed through a rod passage 140 in the ram mounting block 64, parallel to the air ram 62. The cocking rod 134 had its first or front end 135 inside the marker body 14 in mechanical communication with the link pin 128 on the striker 100. The cocking rod front end 135 has a stop means 138 at its terminus to engage the link pin 128 when the cocking rod 134 is manually operated, but to disengage the link pin 128 when the striker 100 is itself otherwise moved. The link pin 128 not only serves to couple the cocking rod 134 to the striker 100 hut also serves to maintain the striker 100 in the proper orientation the under bore 20, 50 that the trigger notch 105 is always bottom most on the striker 100. The second or rear end 136 of the cocking rod 134 extended through the ram block 64 and outside the marker receiver 14. The second or rear cocking rod end 136 was adapted to be manually gripped and withdrawn from the marker receiver 14 to place hammer 54 of the bolt and hammer assembly 40 in a cocked configuration. FIG. 3 is a rear view of the air ram mounting block 64 and the hammer tensioner mount 106 showing the over and tinder relationship of the two components as installed in the receiver 14 of the marker gun 10.

Figure 4:
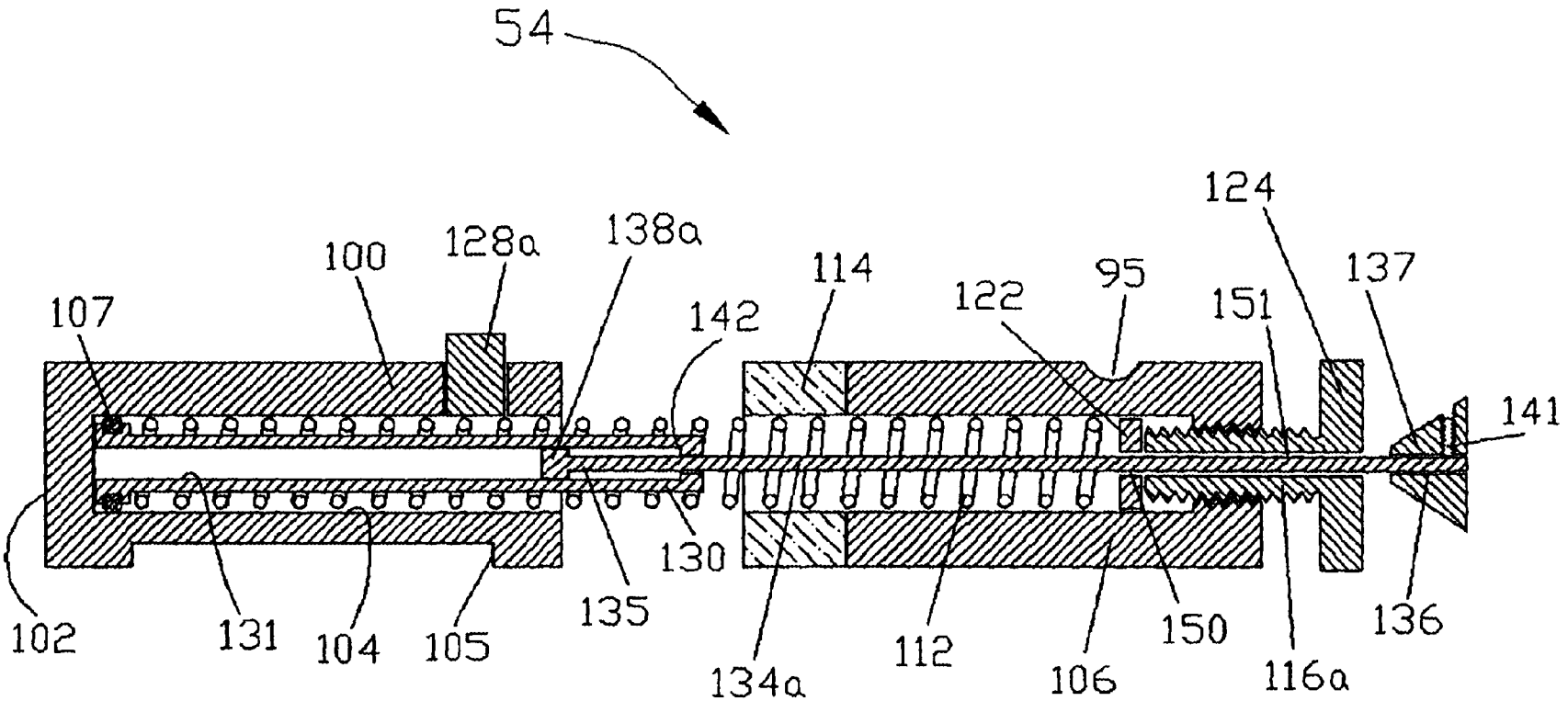
FIG. 4 is a cross-sectional view of an alternative hammer assembly for use in the present invention.

In an alternative embodiment shown in FIG. 4, the cocking rod 134*a* may be completely integral to the hammer assembly 54, i.e., the cocking rod disposed completely as part of the hammer assembly 54. In this embodiment, the cocking rod 134*a* does not engage the link pin 128 or any portion of the bolt assembly, but rather, is disposed to engage a striker insert tube 130 received in the lumen 104 of the striker 100. The cocking rod 134*a* then extends from the marker gun receiver 14 by passing through the tensioner mount 106 and velocity adjuster 116*a* rather than the air ram mounting block 64. The striker insert tube 130 moves in unison with the striker 100. In the preferred embodiment shown, a friction link provided by the O-ring 107 connects the striker 100 and striker insert tube 130 allowing them to moves in unison in the under bore 20 of the receiver 14. As the striker 100 and insert tube 130 combination travel forward and backward in the under bore 20, such as when the marker gun 10 is being fired, the striker insert 130 slides freely over the cocking rod 134*a* in the striker hollow 131. Preferably, the cocking rod 134*a* remains stationary during firing. When the striker 100 is in a forward position (i.e., the hammer spring 112 is in an extended or uncompressed configuration), and the gun 10 needs to be manually cocked (i.e., the striker 100 brought to the back position so that the trigger notch 105 may engage the trigger sear 34), the cocking rod 134*a* is moved backwards by pulling backwards on the cocking knob 137 attached to the cocking rod rear end 136. This draws the cocking rod 134*a* through central bores 150 & 151 in the thrust plate 122 and velocity adjuster 116*a* which each have holes through them allowing the cocking rod 134*a* to slide semi-freely through them. The resistance to movement encountered by the cocking rod 134*a* passing through these bores 150 & 151 is not sufficient to hinder manually cocking gun 10, but is sufficient to prevent the movement of the cocking rod 134*a* upon the automatic cocking of the gun 10. When the cocking rod 134*a* is drawn backwards, the cocking rod stop 138*a*, shown in this embodiment as an enlargement at the cocking rod front end 135 (which usually slides freely inside the striker insert 130), engages the rod seat 142 of the striker insert 130. In the embodiment shown, the rod seat 142 is a reduced internal diameter of the back end of the striker insert tube 130. This allows the striker 100 and insert 130 combination to be drawn backwards by the cocking rod 134*a*. The link pin 128*a* maintains the axial orientation of the striker 100 and prevents it from rotating in the under bore 20 of the receiver 14.

Also illustrated in this embodiment is a bumper pad 114 which may be incorporated into a hammer assembly to cushion or reduce the recoil of the striker 100 at the end of its backward travel. The bumper pad 114 was made of a rubber type material in the embodiment shown, but any other suitable materials as selectable by one of skill in the art may be used. The cocking knob 137 is illustrated as attached to the cocking rod rear end 136 by means of a set screw 141. However, alternative mean for providing a cocking knob 137 at the cocking rod rear end 136 are known to the ordinary skilled artisan and are readily accomplishable in the present invention. For example, the cocking rod rear end 136 can end in a loop to facilitate its being manually grasped.

Figure 5:
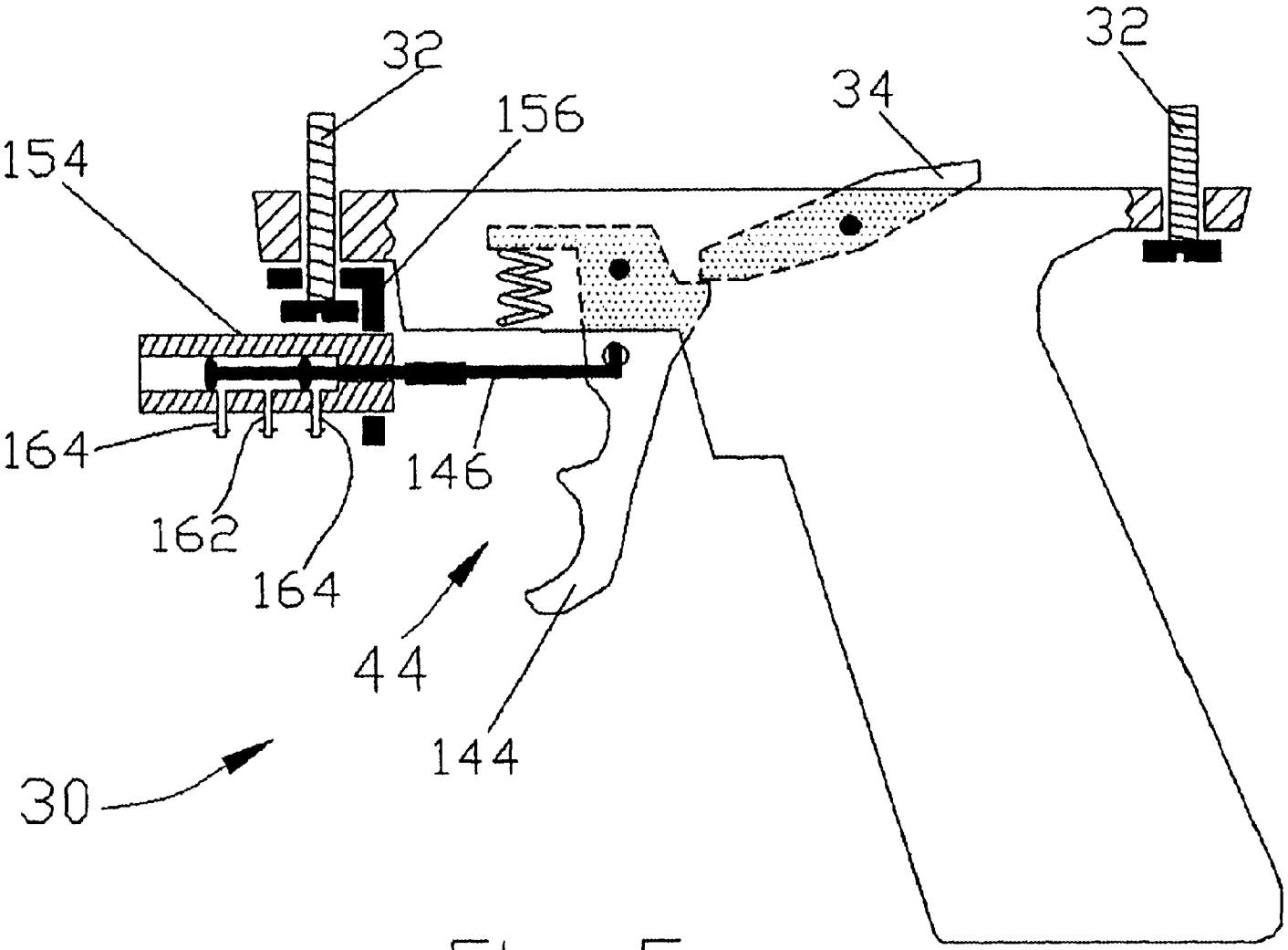
FIG. 5 is a partial cross-sectional view of the trigger group and the components of the pressure control assembly that attached to it.
Figure 6:
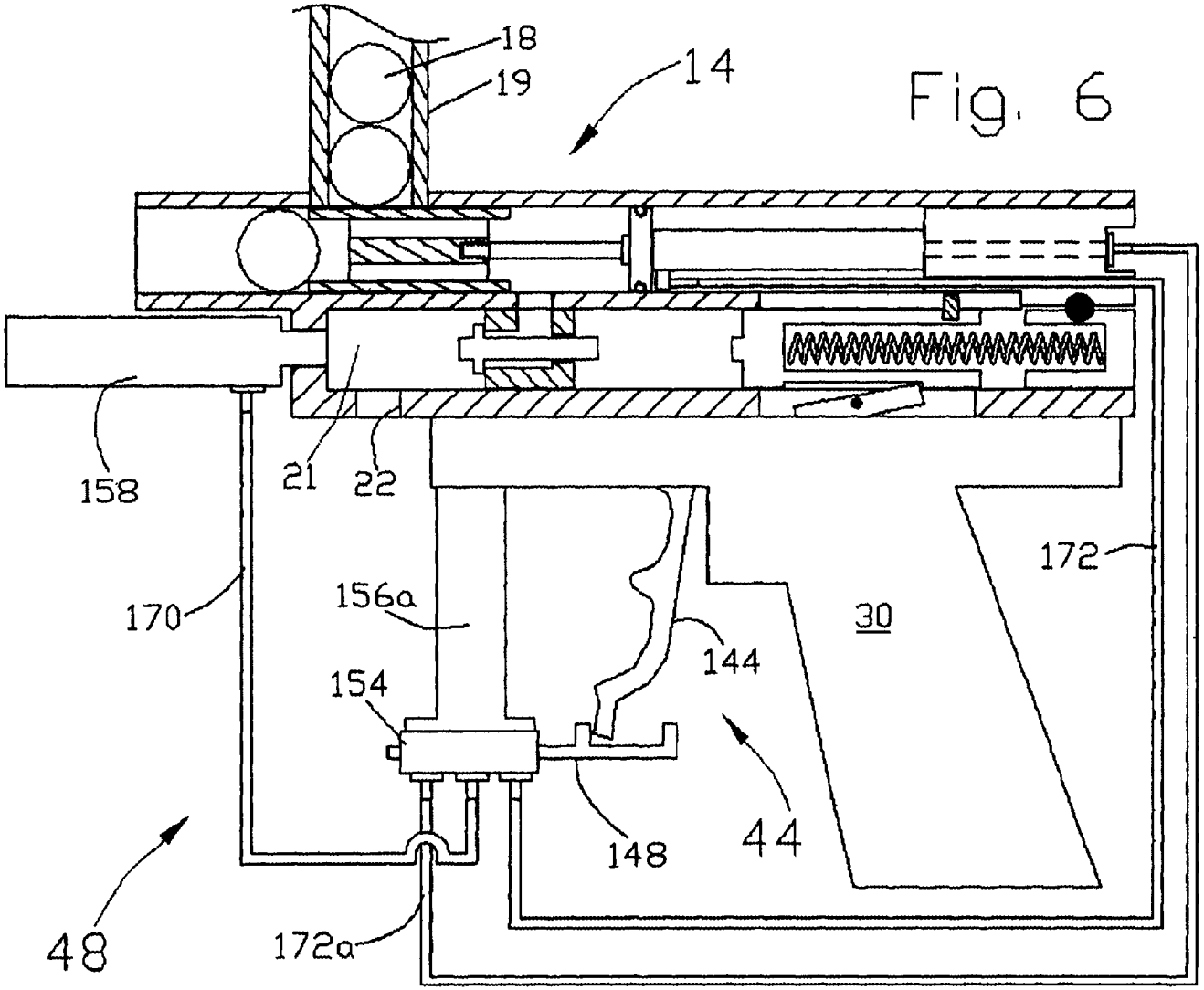
FIG. 6 is a partial cross-sectional view showing the low pressure gas line connections and an alternative mounting means for the two-way low pressure gas valve.

As shown in FIG. 5, the actuator assembly 44 is disposed in the trigger group (frame) 30 in mechanical communication with the bolt and hammer assembly 40. As shown in 2B, the actuator assembly 44 in combination with the trigger group acts to releaseably holding the hammer 54 in a cocked configuration. The actuator assembly 44 comprises a trigger 144 in direct mechanical communication with the pressure control assembly 48 and with the trigger sear 34. The trigger sear 34 extends through the sear notch 35 (see FIG. 1), and is the means for releaseably holding the hammer 54 in a cocked configuration. A link rod 146 mechanically connects the trigger 144 to the pressure control assembly 48. Alternatively, a slide arm 148 has been used to mechanically connect the trigger 144 to the pressure control assembly 48 using an appropriate mounting bracket 156*a*, see FIG. 6.

The pressure control assembly 48 is in mechanical communication with the trigger 144 of the actuator assembly 48, and in gas flow communication with the bolt and hammer assembly 40. The pressure control assembly 48 comprises a low pressure (L/P) gas valve 154 and mounting bracket 156, a low pressure gas regulator 158, and a plurality of low pressure gas lines. L/P pressure regulators practiced in a preferred embodiment of the present invention were the ANS JACKHAMMER™ and JACKHAMMER II™. Other L/P pressure regulators practicable in the present invention include PALMERS PURSUIT SHOP's ROCK REG™ and MINI ROCK™. SHOCKTECH is another manufacturer of LIP gas regulators.

In a preferred embodiment shown in FIG. 1, the L/P gas valve 154 was a slide operated, two-way valve. The L/P valve 154 was a two way valve in that it had a common input port 162 and two alternately selectable valve output ports 164. The L/P gas valve 154 is operable to provide gas flow communication between the common input port 162 and one or the other, but not both, of the LIP valve output ports 164 The L/P valve used in the embodiment of FIG. 1 was manufactured by ANS and purchased over the counter. However, similar valves are commercially available and known to one of skill in the art, and are adaptable for practice in the present invention without undue experimentation. These include the PALMER QUICKSWITCH™, SHOCKTECH's THE BOMB™. Other sources of appropriate valves include WGP, KAPP and ACM. A port selector means 168 extended from the L/P gas valve 154 and mechanically communicated with the trigger 144 of the actuator assembly 44 via the link rod 146. A bracket 156 was used to attach the LIP gas valve 154 to the marker gun frame 14 proximate the trigger 144.

A primary or input L/P gas line 170 is connected between the L/P valve input port and the L/P regulator output port 178. A first and a second secondary L/P gas lines 172 & 172*a* are each connected between an L/P gas valve output port 164, respectively, and the pneumatic cylinder 63 of the air ram 62. The the first secondary L/P gas line 172 is connected to the piston return port 74 on the air ram 62, and the second secondary L/P gas line 172*a* is connected to the piston extension port 75 on the air ram 62.

The L/P gas regulator 158 is mounted at the front of the under bore 20 of the receiver 14 in gas flow communication with the high pressure gas chamber 21 The L/P gas regulator 158 takes high pressure gas from the high pressure gas chamber 21 and reduces the pressure to provide low pressure gas at its output port 178 to provide the low pressure gas requirements of the remainder of the pressure control assembly 48. In a preferred embodiment, the LIP gas regulator 158 was mounted using an adapter plug, 160, and was adjustable to regulate the amount of reduction of gas pressure accomplished by the L/P gas regulator 158.

The present closed bolt action assembly was used to convert an existing paintball marker gun from an open bolt action to a closed bolt action in the following manner:

the existing bolt and hammer assembly was removed from the marker gun 10, and the present bolt and hammer assembly 40 was installed in the marker gun 10 with out modification of the existing receiver 14;

the existing trigger was removed from the trigger group or frame 30 of the marker gun 10, and replaced with the present actuator assembly 44, again without structural modification of the existing marker frame 14; and the present pressure control assembly 48 was installed on the marker gun 10, and connected to the actuator assembly 44 and to the bolt and hammer assembly 40 as described above, to provide a paintball marker gun having a closed bolt action.

For the convenience of an end user, the present invention is provided as a kit for converting an open bolt action paintball marker gun to a closed bolt action The kit comprises the closed bolt action assembly of the present invention, instructions on how to accomplish the conversion, and a container 200 for holding the instructions, the present closed bolt action assembly and any ancillary parts or tools that may be desirable by one of ordinary skill in the art to include in the kit for the benefit of an end user.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A closed bolt action assembly for a gas operated paintball marker gun having a marker gun body and frame, the action assembly comprising:

a combination bolt and hammer assembly releaseably containable in the marker gun body, the marker body being mounted on the marker gun frame;

an actuator assembly disposed in the marker gun frame in mechanical communication with the bolt and hammer assembly, for releaseably holding the bolt and hammer assembly in a cocked configuration; and a pressure control assembly in mechanical communication with the actuator assembly and in gas how communication with the bolt and hammer assembly.

2. The action assembly of claim 1, wherein the combination bolt and hammer assembly further comprises a bolt assembly and a hammer assembly which are removably retainable in the marker body, the bolt assembly for opening and closing a breech of the marker gun to load a paintball projectile into the marker gun, and for positioning the projectile into a chamber of a barrel of the marker gun, and the hammer assembly for operating a high pressure gas valve to open a high pressure gas flow path between a source of high pressure gas and the chamber of the barrel, through the bolt.

3. The bolt assembly of claim 2, further comprising an air ram having two ends with a double action piston, a shaft of which piston protrudes from a first end of the ram a ram mounting block receiving a second end of the air ram and for releaseably retaining the bolt assembly in the marker body, and two low pressure gas ports disposed one proximate each end of the ram in communication with an interior space of the ram, and a bolt head connected to a shaft end of the piston shaft.

4. The bolt assembly of claim 3, further comprising a bolt sealing disk disposed proximate the first end of the ram, the disk for providing stability to the bolt and pneumatic isolation of the bolt head from the air ram.

5. The bolt assembly of claim 3, further comprising the bolt head being a cylinder having a central axis, a solid circumferential surface, a bolt-face end and a breech end, an inside-mating surface along at least a portion of the central axis, and a plurality of gas flow passage passages communicating between and through the bolt-face and breech ends of the bolt head.

6. The combination bolt and hammer assembly of claim 2, wherein the hammer assembly further comprises a cylindrical striker in axial alignment with a cylindrical tensioner block and a bias spring disposed along an axis between the striker and the block and biased to axially separate the striker from the mount block the striker having a coaxial lumen along a portion of its axis for receiving a forward end of the bias spring and the tensioner block having a coaxial lumen along a portion of its axis for receiving a backward end of the bias spring.

7. The hammer assembly of claim 6, wherein the tensioner block has a pre-loading means for adjusting the bias of the bias spring.

8. The hammer assembly of claim 6, wherein the tensioner block has an adjusting screw for pre-loading a bias on the bias spring.

9. The combination bolt and hammer assembly of claim 6, further comprising a cocking rod, the cocking rod slidably passing through a ram mounting block and in parallel to all air ram of the bolt assembly, the cocking rod having a first end in mechanical communication with a link pin on the striker of the hammer assembly, and a second end outside the marker body, the second end adapted to be manually gripped and withdrawn from the marker body to place the hammer assembly of the combination bolt and hammer assembly in a cocked configuration.

10. The combination bolt and hammer assembly of claim 6, further comprising an integral cocking rod disposed completely with in the hammer assembly.

11. The action assembly of claim 2, wherein the bolt and hammer assembly further comprises a detent physically disposed in part on the bolt and on the hammer, the detent alignable with a through hole in the marker body, the through hole for receiving a locking cross pin, and the cross pin for engaging the detent and securing the action assembly in the marker body.

12. The action assembly of claim 1, wherein the actuator assembly comprises a trigger in direct mechanical communication with the pressure control assembly and with a means for releaseably holding the hammer of the bolt and hammer assembly in a cocked configuration.

13. The actuator assembly of claim 12, wherein a link rod mechanically connects the trigger to the pressure control assembly.

14. The actuator assembly of claim 12, wherein a slide switch mechanically connects the trigger to the pressure control assembly.

15. The action assembly of claim 1, wherein the pressure control assembly comprises:

a slide operated, two-way, low pressure gas valve in direct mechanical communication with the actuator assembly;

a mount attaching the low pressure gas valve to the marker gun frame;

a primary low pressure gas line and a first and a second secondary gas lines, each connected at one end to the low pressure gas valve, and at the other end, the primary gas line is connected to a low pressure gas regulator, the first secondary gas line is connected to a piston return port on the air ram, and the second secondary gas line is connected to the piston extension port on the air ram; and a low pressure gas regulator connected to the marker gun body and in gas how communication with a high pressure gas source and with the other end of the primary low pressure gas line.

16. The pressure control assembly of claim 15, wherein the low pressure gas regulator is adjustable to regulate an amount of reduction of gas pressure accomplished by the regulator.

17. A method of using the closed bolt action assembly of claim 1 to convert a paintball marker gun from an open bolt action to a closed bolt action comprising the steps of:

removing a bolt and hammer assembly of the open bolt action from the marker gun;

installing the combination bolt and hammer assembly in the marker gun;

replacing a trigger from the marker gun with the actuator assembly; and installing the pressure control assembly on the marker gun, and connecting the pressure control assembly to the actuator assembly and to the bolt and hammer assembly to provide a paintball marker gun having a closed bolt action.

18. A kit for converting an open bolt action paintball marker gun to a closed bolt action comprising:

the closed bolt action assembly of claim 1;

instructions; and a container for containing the closed bolt action assembly and the instructions.

* * * * *